US005887314A

United States Patent [19]

Jordan, Jr.

[11] Patent Number: 5,887,314

[45] Date of Patent: Mar. 30, 1999

[54] TELESCOPING HANDLE WITH MULTIPLE ATTACHMENT ENDS

[76] Inventor: Leon J. Jordan, Jr., 27 W. Maple Ave., Middletown, Pa. 17057

[21] Appl. No.: 924,675

[22] Filed: Sep. 5, 1997

[51] Int. Cl.[6] ..... A47B 95/02

[52] U.S. Cl. ..... 16/115; 16/DIG. 41; 15/144.3; 403/110

[58] Field of Search ..... 16/115, DIG. 41; 15/143.1, 144.2, 144.3, 144.4; 403/110, 109, 104, 377, 371

[56] References Cited

U.S. PATENT DOCUMENTS

| | | | |
|---|---|---|---|
| 2,841,425 | 7/1958 | Oeters | 16/115 |
| 2,902,592 | 9/1959 | Cole et al. | 403/110 |
| 3,380,097 | 4/1968 | Pharris | 16/115 |
| 3,489,451 | 1/1970 | Guckenberger | 403/110 |
| 4,182,577 | 1/1980 | O'Dwyer et al. | 15/144.3 |
| 4,524,484 | 6/1985 | Graham | 16/115 |
| 5,606,761 | 3/1997 | Lynch | 15/144.3 |

*Primary Examiner*—Chuck Y. Mah

[57] ABSTRACT

A new Telescoping Handle With Multiple Attachment Ends for providing a multi-purpose cleaning tool with interchangeable cleaning attachments and a telescopic handle. The inventive device includes an elongated tube, an elongated rod slidably positioned within the elongated tube, and a plurality of cleaning attachments for selectively being attached to end of the elongated rod opposite of the elongated tube.

1 Claim, 3 Drawing Sheets

TELESCOPING HANDLE WITH MULTIPLE ATTACHMENT ENDS

BACKGROUND OF THE INVENTION

1. Field of the Invention

The present invention relates to Telescoping Handle Devices and more particularly pertains to a new Telescoping Handle With Multiple Attachment Ends for providing a multi-purpose cleaning tool with interchangeable cleaning attachments and a telescopic handle.

2. Description of the Prior Art

The use of Telescoping Handle Devices is known in the prior art. More specifically, Telescoping Handle Devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art Telescoping Handle Devices include U.S. Pat. No. 4,524,484; U.S. Pat. No. 4,345,351; U.S. Design Pat. No. 354,554; U.S. Pat. No. 4,325,157; U.S. Pat. No. 5,392,673; U.S. Pat. No. 4,461,057; U.S. Pat. No. 4,081,186; U.S. Pat. No. 4,596,405; U.S. Design Pat. No. 283,176; U.S. Pat. No. 4,087,880; U.S. Design Pat. No. 321,793; and U.S. Pat. No. 4,068,346.

While these devices fulfill their respective, particular objectives and requirements, the aforementioned patents do not disclose a new Telescoping Handle With Multiple Attachment Ends. The inventive device includes an elongated tube, an elongated rod slidably positioned within the elongated tube, and a plurality of cleaning attachments for selectively being attached to end of the elongated rod opposite of the elongated tube.

In these respects, the Telescoping Handle With Multiple Attachment Ends according to the present invention substantially departs from the conventional concepts and designs of the prior art, and in so doing provides an apparatus primarily developed for the purpose of providing a multi-purpose cleaning tool with interchangeable cleaning attachments and a telescopic handle.

SUMMARY OF THE INVENTION

In view of the foregoing disadvantages inherent in the known types of Telescoping Handle Devices now present in the prior art, the present invention provides a new Telescoping Handle With Multiple Attachment Ends construction wherein the same can be utilized for providing a multi-purpose cleaning tool with interchangeable cleaning attachments and a telescopic handle.

The general purpose of the present invention, which will be described subsequently in greater detail, is to provide a new Telescoping Handle With Multiple Attachment Ends apparatus and method which has many of the advantages of the Telescoping Handle Devices mentioned heretofore and many novel features that result in a new Telescoping Handle With Multiple Attachment Ends which is not anticipated, rendered obvious, suggested, or even implied by any of the prior art Telescoping Handle Devices, either alone or in any combination thereof.

To attain this, the present invention generally comprises an elongated tube, an elongated rod slidably positioned within the elongated tube, and a plurality of cleaning attachments for selectively being attached to end of the elongated rod opposite of the elongated tube.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new Telescoping Handle With Multiple Attachment Ends apparatus and method which has many of the advantages of the Telescoping Handle Devices mentioned heretofore and many novel features that result in a new Telescoping Handle With Multiple Attachment Ends which is not anticipated, rendered obvious, suggested, or even implied by any of the prior art Telescoping Handle Devices, either alone or in any combination thereof.

It is another object of the present invention to provide a new Telescoping Handle With Multiple Attachment Ends which may be easily and efficiently manufactured and marketed.

It is a further object of the present invention to provide a new Telescoping Handle With Multiple Attachment Ends which is of a durable and reliable construction.

An even further object of the present invention is to provide a new Telescoping Handle With Multiple Attachment Ends which is susceptible of a low cost of manufacture with regard to both materials and labor, and which accordingly is then susceptible of low prices of sale to the consuming public, thereby making such Telescoping Handle With Multiple Attachment Ends economically available to the buying public.

Still yet another object of the present invention is to provide a new Telescoping Handle With Multiple Attachment Ends which provides in the apparatuses and methods of the prior art some of the advantages thereof, while simultaneously overcoming some of the disadvantages normally associated therewith.

Still another object of the present invention is to provide a new Telescoping Handle With Multiple Attachment Ends for providing a multi-purpose cleaning tool with interchangeable cleaning attachments and a telescopic handle.

Yet another object of the present invention is to provide a new Telescoping Handle With Multiple Attachment Ends which includes an elongated tube, an elongated rod slidably positioned within the elongated tube, and a plurality of cleaning attachments for selectively being attached to end of the elongated rod opposite of the elongated tube.

Still yet another object of the present invention is to provide a new Telescoping Handle With Multiple Attachment Ends that is easy to utilize and stores in a compact space.

Even still another object of the present invention is to provide a new Telescoping Handle With Multiple Attachment Ends that when a cleaning head wears out, the user simply has to purchase another cleaning head.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
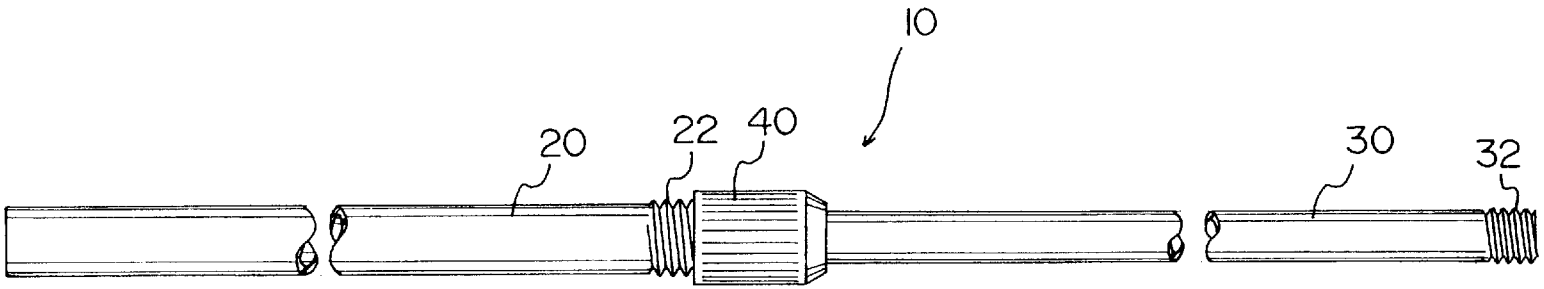
FIG. 1 is a side view of a new Telescoping Handle With Multiple Attachment Ends according to the present invention.

With reference now to the drawings, and in particular to FIGS. 1 through 7 thereof, a new Telescoping Handle With Multiple Attachment Ends embodying the principles and concepts of the present invention and generally designated by the reference numeral 10 will be described.

More specifically, it will be noted that the Telescoping Handle With Multiple Attachment Ends 10 comprises an elongated tube 20 having a first threaded end 22, a flange 24 secured to the threaded end, an elongated rod 30 slidably projecting through the elongated tube 20 through the first threaded end 22, and a threaded collar 40 threadably engaging the first threaded end 22 and surrounding the flange 24 for contracting the first threaded end 22 around the elongated for securing the elongated rod 30 in a selected position for operating or storing. A plurality of slots 26 are within the first threaded end 22 aligned parallel to a longitudinal axis of the elongated tube 20.

Figure 2:
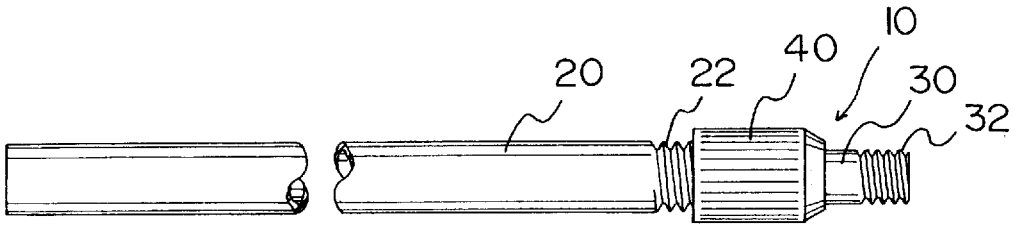
FIG. 2 is a side view of the present invention in the storage position.
Figure 3:
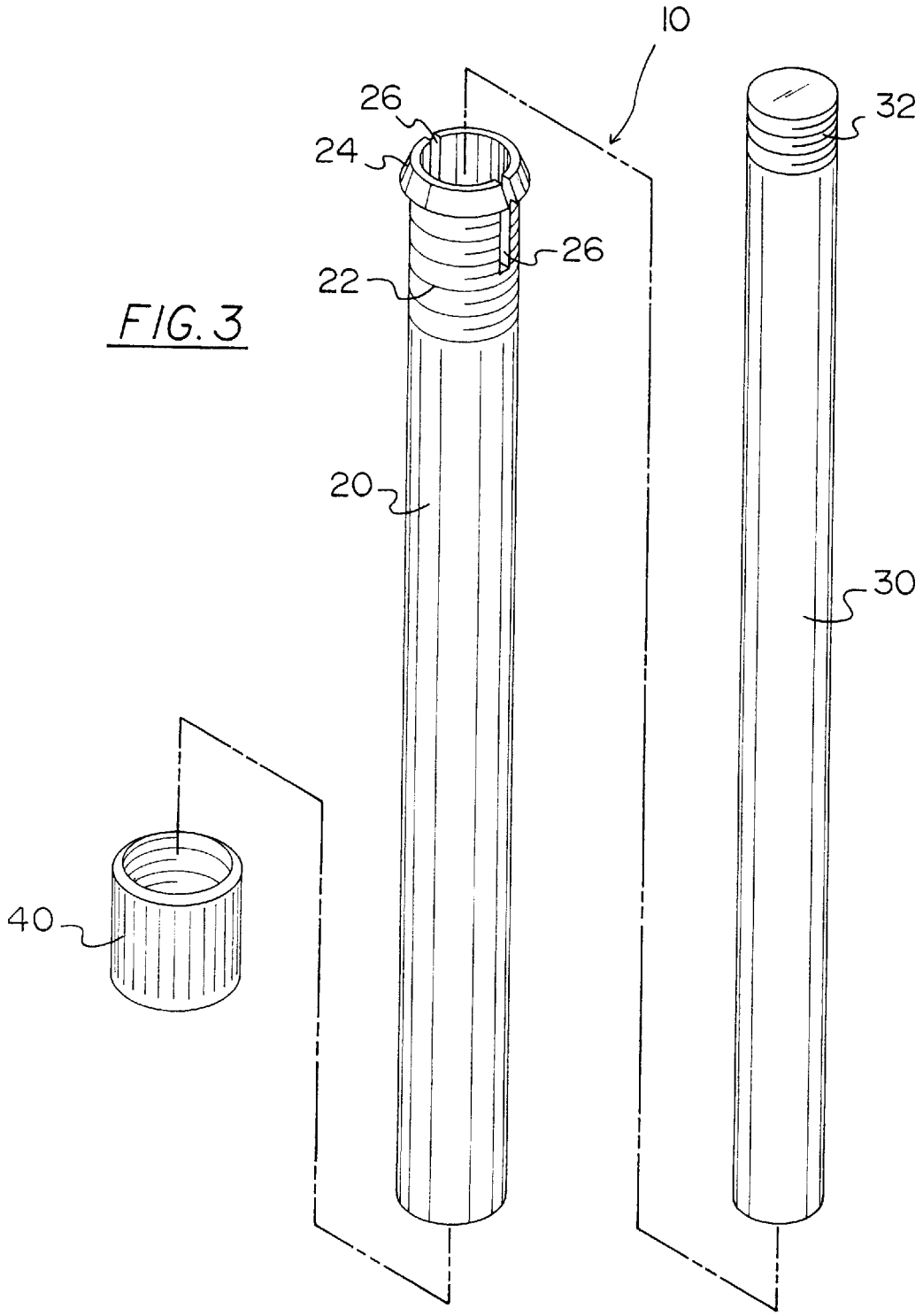
FIG. 3 is an exploded isometric view of the present invention.
Figure 4:
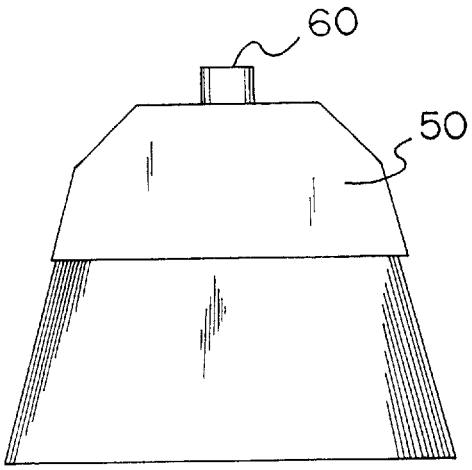
FIG. 4 is a front view of a broom attachment.
Figure 5:
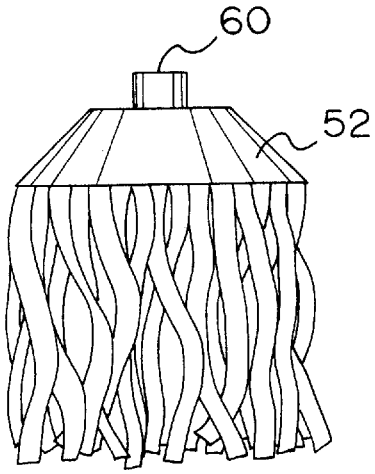
FIG. 5 is a front view of a mop attachment.
Figure 6:
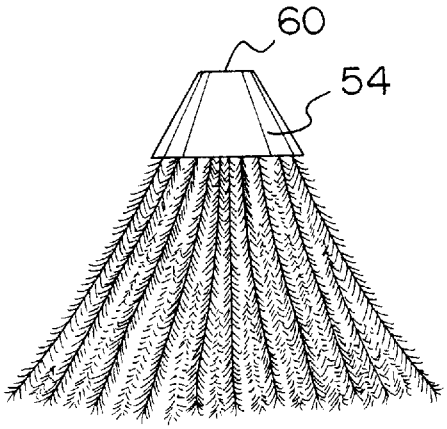
FIG. 6 is a front view of a dusting attachment.
Figure 7:
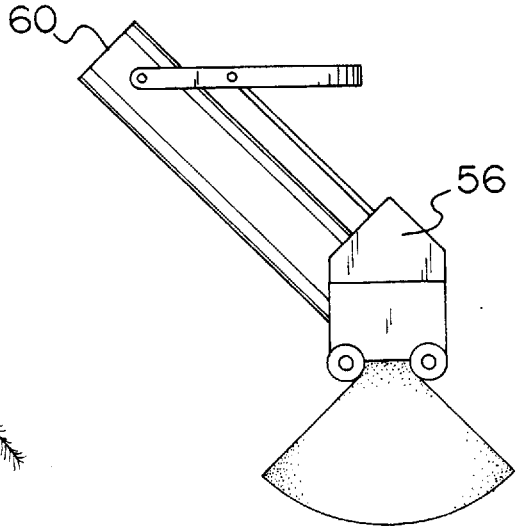
FIG. 7 is a front view of a sponge mop attachment.

As shown in FIGS. 1 through 3 of the drawings, the elongated rod 30 has a second threaded end 32 opposite of the first threaded end 22. As shown in FIG. 4, a broom attachment 50 has an interiorly threaded member 60 for securing to the second threaded end 32. As shown in FIG. 5 of the drawings, a mop attachment 52 has an interiorly threaded member 60 for securing to the second threaded end 32. As shown in FIG. 6 of the drawings, a dusting attachment 54 has an interiorly threaded member 60 for securing to the second threaded end 32. As shown in FIG. 7 of the drawings, a sponge mop attachment 56 has an interiorly threaded member 60 for securing to the second threaded end 32.

In use, the user adjusts the required length of the present invention by loosening the threaded collar 40 which allows the elongated rod 30 to freely slide within the elongated tube 20. After the desired length is achieved, the user tightens the threaded collar 40 upon the flange 24 and the first threaded end 22 thereby tightening the first threaded end 22 against the elongated rod 30 opposite of the second threaded end 32. The user then secures the desired attachment 50, 52, 54 or 56 by threadably engaging the interiorly threaded member 60 secured to the desired attachment 50, 52, 54 or 56 onto the second threaded end 32. After the user is finished utilizing the present invention, the above process is reversed until the elongated rod 30 is stored conveniently and compact within the elongated tube 20.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A telescoping handle with multiple implements comprising:

an elongated tube having a first threaded end;

a plurality of slots within said first threaded end aligned parallel to a longitudinal axis of said elongated tube;

a flange secured to said threaded end and extending radially outward therefrom with a frusto-conical configuration;

an elongated rod slidably projecting through said elongated tube and through said first threaded end, the elongated rod having a length equal to that of the elongated tube;

a threaded collar having a cylindrical inboard portion and a frusto-conical outboard portion, the threaded collar threadably engaging said first threaded end and surrounding said flange for contracting said first threaded end around said elongated rod for securing said elongated rod in a selected position for operating or storing;

wherein said elongated rod includes a second threaded end opposite of said first threaded end;

a broom implement for sweeping floor surfaces and having an interiorly threaded member for selectively securing to said second threaded end, the broom implement having a plurality of bristles protruding therefrom;

a mop implement for cleaning floor surfaces and having a post with an interiorly threaded member for selectively securing to said second threaded end, the mop implement having a plurality of strips of absorbent material extending therefrom;

a dusting implement for cleaning dust from surfaces and having an interiorly threaded member for selectively securing to said second threaded end, the dusting element having a plurality of feather members extending therefrom; and a sponge mop implement for washing floor surfaces and having an interiorly threaded member for selectively securing to said second threaded end, the sponge mop implement further including a lever pivotally mounted on the post and connected to a wringer adapted to allow manual wringing of a mop of the sponge mop implement.

* * * * *